US006031337A

United States Patent [19]

Wang et al.

[11] Patent Number: 6,031,337

[45] Date of Patent: Feb. 29, 2000

[54] ASSEMBLY STRUCTURE FOR CHRISTMAS LIGHT STRING CONTROLLER

[76] Inventors: Jessica Wang; Dennis Wang, both of 4F-3, No. 77, Sec. 2, Tun Hwa South Road, Taipei, Taiwan

[21] Appl. No.: 09/267,624

[22] Filed: Mar. 15, 1999

[51] Int. Cl.[7] ..... H05B 37/00

[52] U.S. Cl. ..... 315/185 R; 315/185 S

[58] Field of Search ..... 315/185 R, 185 S; 200/345, 336; 362/251

[56] References Cited

U.S. PATENT DOCUMENTS 5,504,397 4/1996 Chien ..... 315/185 S

*Primary Examiner*—David H. Vu
*Attorney, Agent, or Firm*—Dougherty & Troxell

[57] ABSTRACT

An assembly structure for a Christmas light string controller includes a top cover, a bottom cover and a controlling switch. The bottom cover defines therein an interior space for receiving a first and second circuit boards. The top face of the first circuit board is substantially flush with the top edge of the bottom cover. The second circuit board is perpendicularly received in the interior space of the bottom cover and the top end of the second circuit board is connected with the first circuit board. The controlling switch is positioned above a contact area of the first circuit board. By means of operating the controlling switch, an actuating signal is sent to the conductive wires for controlling the flickering of the Christmas light string.

5 Claims, 5 Drawing Sheets

ASSEMBLY STRUCTURE FOR CHRISTMAS LIGHT STRING CONTROLLER

BACKGROUND OF THE INVENTION

1. Field of the Invention

The present invention relates to an improved Christmas light string controller, and more particularly to a Christmas light string controller having better waterproof structure and mechanical strength.

2. Description of the Prior Art

Christmas light string not only is used as a decoration in Christmas season, but also is widely used as a light-emitting decoration on various situations. In the measure for controlling the flickering of the light string, conventionally, at least one flashing control bulb is serially connected with the light string. By means of the heating and cooling of the bi-metal thermal plate arranged in the flashing control bulb, the flickering effect of the entire light string can be controlled.

In order to achieve a better flickering-controlling effect for the Christmas light string, an IC controller has been specifically developed for controlling the Christmas light string. Such controller mainly includes an integrated circuit and relevant electronic circuits for controlling the flickering effect. By means of the sequential actuating signals generated by the integrated circuit, a more versatile flickering-controlling effect can be achieved.

However, the conventional IC controller is designed as a rectangular box structure. When hung on the light string, the controller is not accordant with the light string. This deteriorates the entire appearance of the Christmas light string.

Moreover, the conventional controller lacks a waterproof and humidityproof structural design. Therefore, when the Christmas light string is positioned outdoors, the ambient water or humidity may intrude into the controller to affect the normal functions of the integrated circuit and other electronic circuit elements.

In addition, the conventional rectangular controller structure has poor mechanical strength. In case the controller is dropped down or compressed incautiously, the controller may be damaged.

SUMMARY OF THE INVENTION

It is a primary object of the present invention to provide an improved Christmas light string controller which has a housing with better appearance, so that when hung on the Christmas light string, the controller is accordant with the light string, also serving as a part of the decoration and enhancing the beauty of the appearance thereof.

It is a further object of the present invention to provide an improved Christmas light string controller having a waterproof and humidityproof structure for effectively isolating the interior of the controller from water or humidity.

It is still a further object of the present invention to provide an improved Christmas light string controller having better mechanical strength. In case the controller is incautiously dropped down or collided by other articles, the controller is prevented from being damaged.

The present invention can be best understood through the following description and accompanying drawings wherein:

DETAILED DESCRIPTION OF THE PREFERRED EMBODIMENTS

Figure 1:
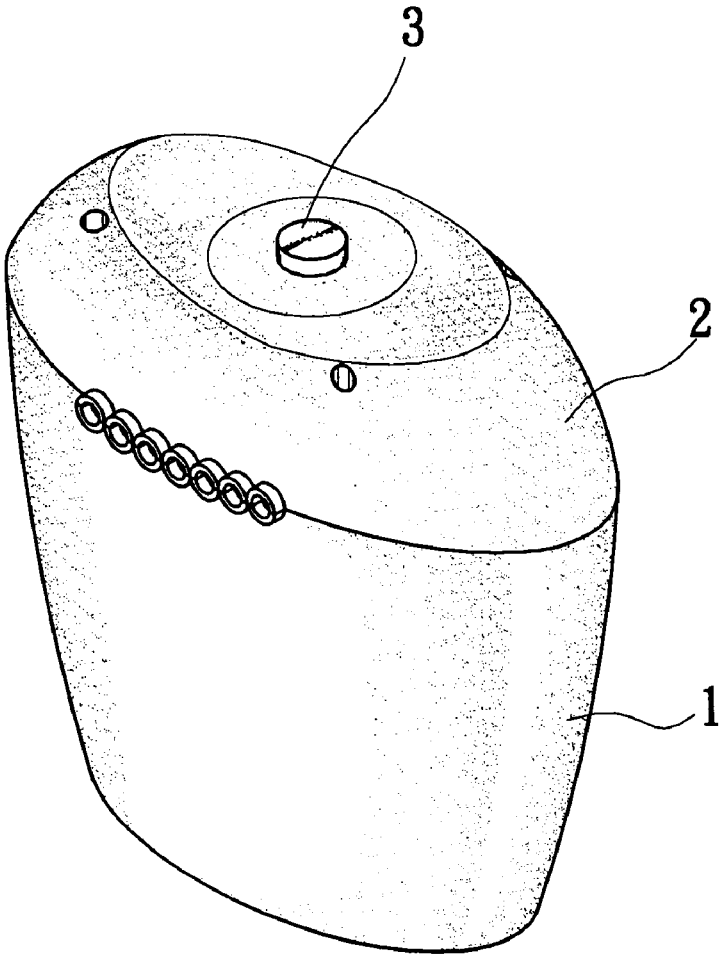
FIG. 1 is a perspective view of a first embodiment of the present invention.
Figure 2:
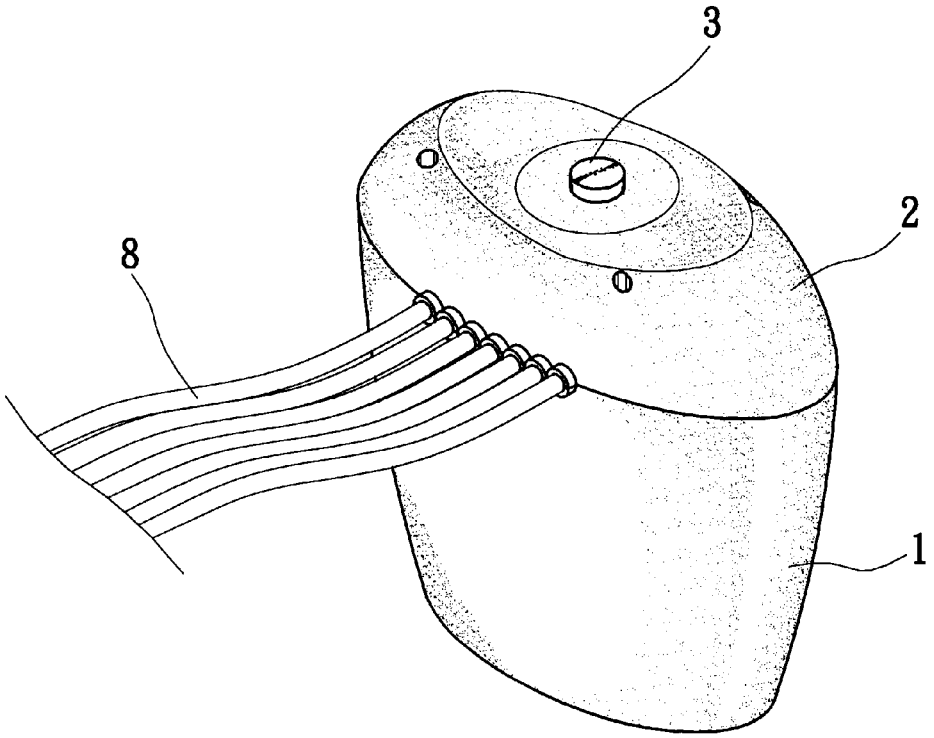
FIG. 2 is a perspective view showing that the controller of the present invention is connected with a conductive wire.
Figure 3:
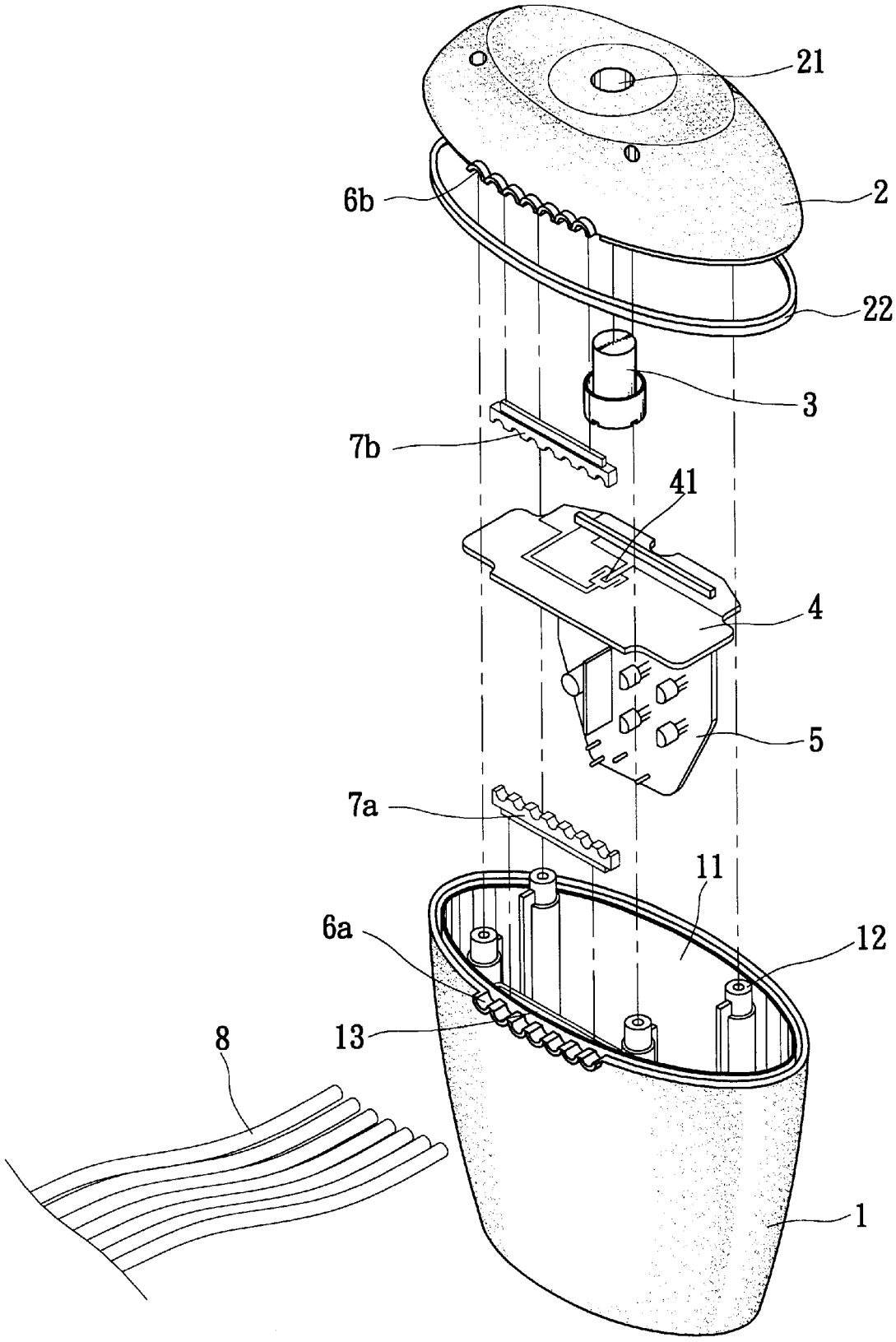
FIG. 3 is a perspective exploded view of the controller of the present invention.

Please refer to FIGS. 1 to 3 which show a first embodiment of the present invention. The controller includes a bottom cover 1 defining an interior space 11 having an open top face. An inner side wall of the bottom cover 1 is disposed with several thread posts 12.

The interior space 11 of the bottom cover 1 serves to receive therein a first circuit board 4 and a second circuit board 5. The first circuit board 4 is horizontally positioned in the bottom cover 1 with its top face substantially flush with the top edge of the bottom cover 1. The second circuit board 5 is perpendicularly connected to the bottom face of the first circuit board 4.

The center of the top face of the first circuit board 4 is disposed with a contact area 41 which is able to send out an actuating signal under control of a controlling switch. In this embodiment, the controlling switch is push button 3 having an electric conductive area on the bottom face. Accordingly, when pressing down the push button 3, the conductive area thereof contacts with the contact area 41 to generate an actuating signal to the circuit board.

Figure 4:
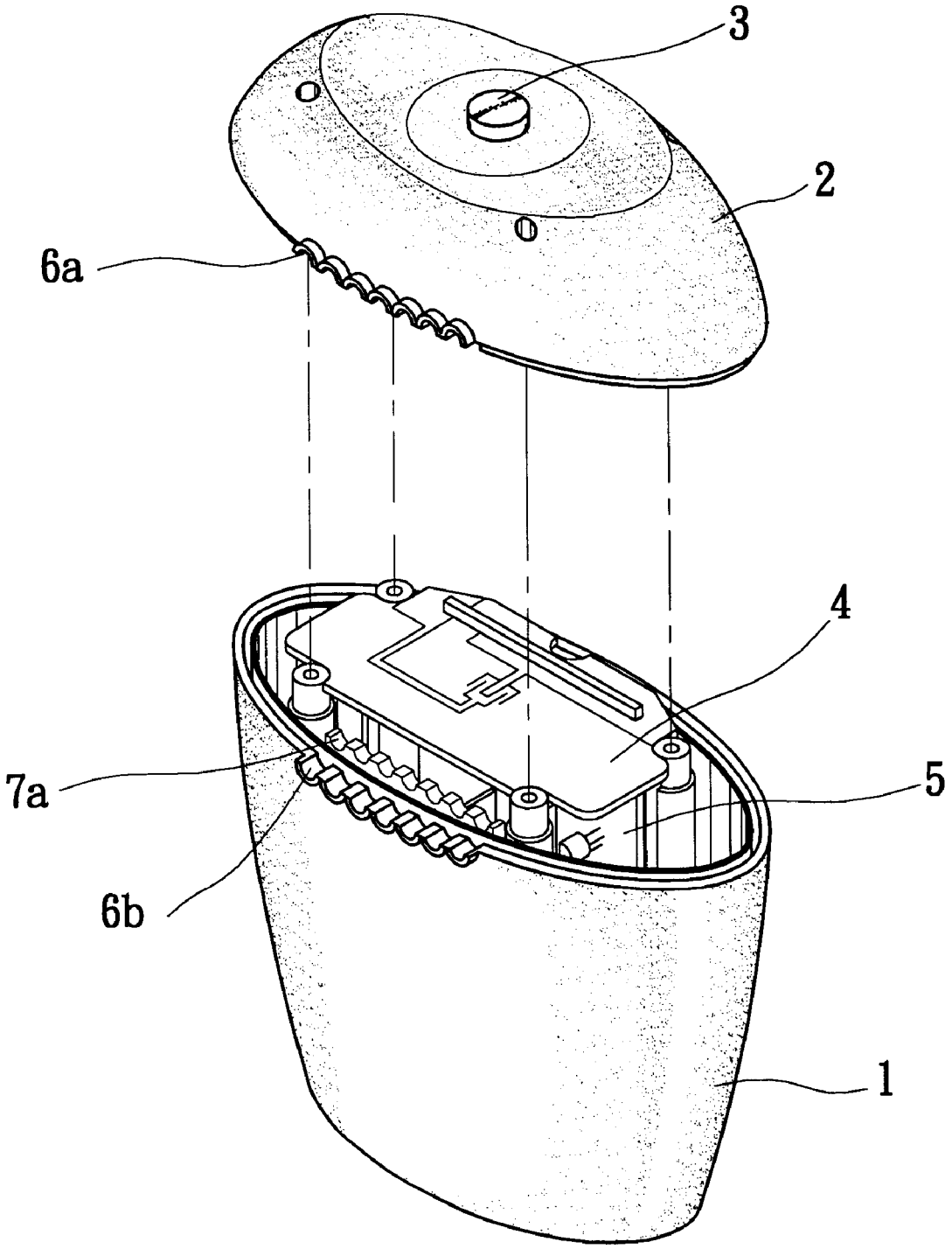
FIG. 4 is a perspective exploded view showing that the top cover and bottom cover of the controller are detached from each other.

The push button 3, first circuit board 4 and second circuit board 5 are sequentially assembled into the bottom cover 1 (referring to FIG. 4). Thereafter, the top cover 2 is mated with the top edge of the bottom cover 1 and secured thereto by screws (not shown). After assembled, the push button 3 protrudes beyond the central opening 21 of the top cover 2. A waterproof washer 22 is sandwiched between the top cover 2 and the bottom cover 1 for achieving a waterproof effect.

The first circuit board 4 is disposed with connecting points for connecting with several conductive wires 8 which serve to control the flickering of the Christmas light string. In addition, the top edge of the bottom cover 1 is formed with several semicircular notches 6*a* and the bottom edge of the top cover 2 is formed with several corresponding semicircular notches 6*b*. When the top cover 2 and the bottom cover 1 are mated with each other, the semicircular notches 6*a*, 6*b* together define circular through holes for the conductive wire 8 to pass therethrough and connect with the first circuit board 4.

In addition, the inner side wall of the bottom cover 1 is disposed with a sink seat 13 for placing a rubber pad 7*a* therein. The inner side wall of the top cover 2 is also formed with a corresponding sink seat in which a rubber pad 7*b* is placed. Accordingly, when the conductive wires extend inward to connect with the connecting points of the first circuit board 4, the rubber pads 7*a*, 7*b* oppositely clamp the conductive wires to achieve an even better waterproof effect.

Figure 5:
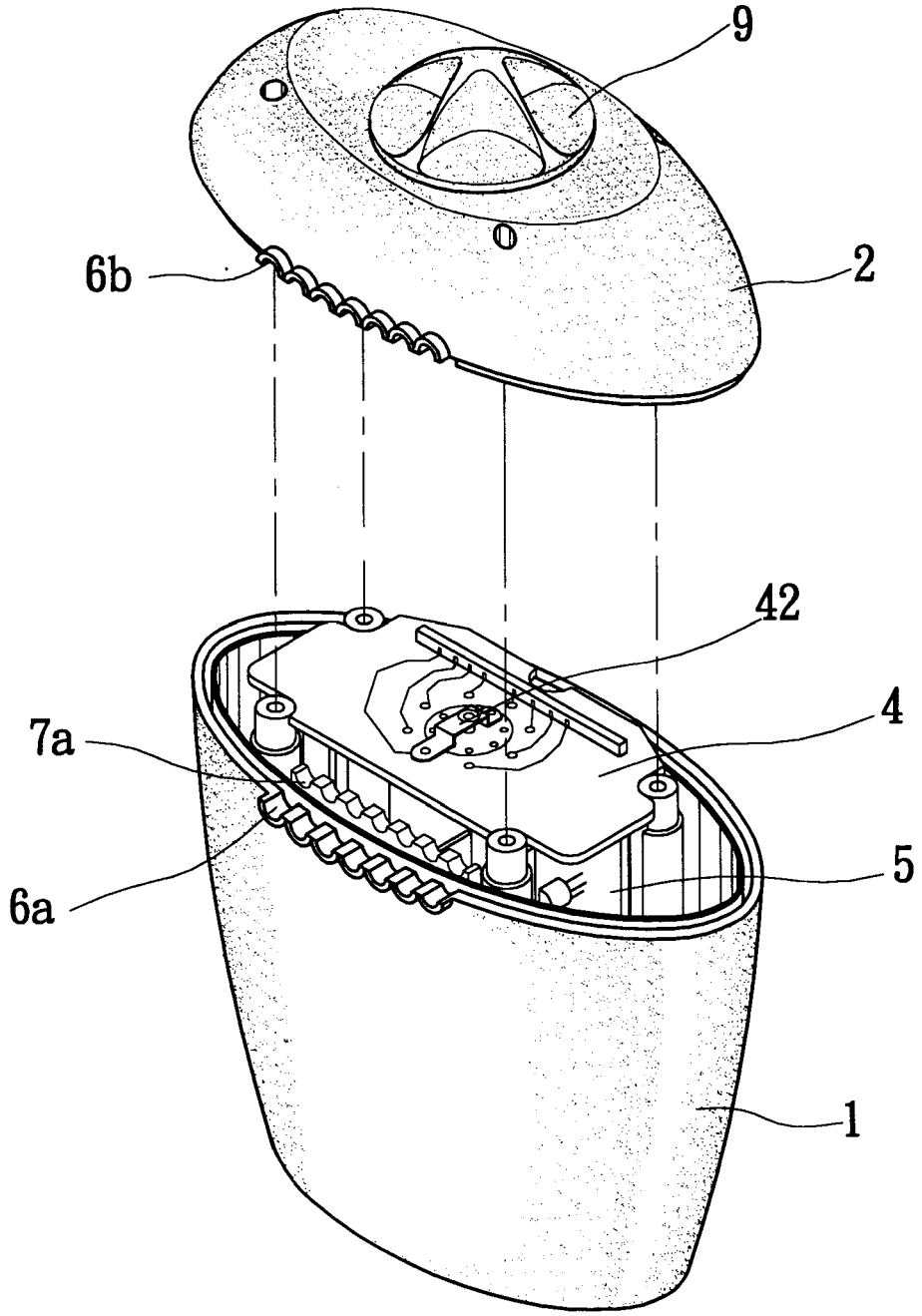
FIG. 5 is a perspective view of a second embodiment of the present invention.

FIG. 5 shows a second embodiment of the present invention, in which most of the structure is identical to that of the first embodiment described above. The difference between the first and second embodiments resides in that a rotary switch 9 is used instead of the push button 3 of the first embodiment. In addition, the central portion of the top face of the first circuit board 4 is disposed with a rotary switch contact mechanism 42. When a user rotates the rotary switch 9, the rotary switch contact mechanism 42 is driven to rotate and through the contact area generates an actuating signal to the circuit board.

The above embodiments are only used to illustrate the present invention, not intended to limit the scope thereof. Many modifications of the above embodiments can be made without departing from the spirit of the present invention.

What is claimed is:

1. An assembly structure of a Christmas light string controller connected with a plurality of conductive wires for controlling flickering of a Christmas light string, said assembly structure of the Christmas light string controller comprising:

a top cover, a central portion of a top section of the top cover being formed with an opening, a bottom edge of the top cover being formed with several semicircular notches;

a bottom cover defining therein an interior space and having a top open end, a top edge of the bottom cover being formed with several semicircular notches, whereby when the top cover and the bottom cover are mated with each other, the semicircular notches together form circular through holes for the conductive wires to extend therethrough into the controller;

a first circuit board, a top face of the first circuit board being disposed with a contact area, the top face of the first circuit board being substantially flush with the top edge of the bottom cover;

a second circuit board perpendicularly received in the interior space of the bottom cover, a top end of the second circuit board being mounted with the first circuit board; and a controlling switch positioned above the contact area of the first circuit board, whereby by means of operating the controlling switch, an actuating signal is sent to the conductive wires for controlling the flickering of the Christmas light string.

2. The assembly structure of the Christmas light string controller as claimed in claim 1, wherein the controlling switch is a push button.

3. The assembly structure of the Christmas light string controller as claimed in claim 1, wherein the controlling switch is a rotary switch.

4. The assembly structure of the Christmas light string controller as claimed in claim 1, wherein a waterproof washer is further sandwiched between the top cover and the bottom cover.

5. The assembly structure of the Christmas light string controller as claimed in claim 1, wherein an inner side wall of the bottom cover is disposed with a sink seat for placing a rubber pad therein and an inner side wall of the top cover is also formed with a corresponding sink seat in which a rubber pad is placed, whereby the rubber pads are mated with each other to oppositely clamp the conductive wires.

* * * * *